United States Patent [19]

Gött et al.

[11] 4,020,669

[45] May 3, 1977

[54] MACHINE FOR BENDING BAR OR ROD MATERIAL

[75] Inventors: Hans Gött; Josef Ritter

[73] Assignees: Firma Evg Entwicklungs-u Verwertungsgesellschaft, Graz, Austria; Klaus Ritter; Gerhard Ritter, all of Graz, Austria

[22] Filed: Apr. 28, 1976

[21] Appl. No.: 681,336

[30] Foreign Application Priority Data

May 6, 1975 Austria ..... 3467/75

[52] U.S. Cl. ..... 72/294; 72/203; 72/217; 72/297; 72/332

[51] Int. Cl.[2] ..... B21D 43/28; B21B 7/024

[58] Field of Search ..... 72/294, 388, 203, 308, 72/310, 326, 334, 129, 132, 217

[56] References Cited

UNITED STATES PATENTS

| | | | |
|---|---|---|---|
| 670,891 | 3/1901 | Cady | 72/203 |
| 2,424,024 | 7/1947 | Garton | 72/388 |
| 3,120,915 | 2/1964 | Horn et al. | 72/294 |
| 3,269,164 | 8/1966 | Rutter | 72/334 |

FOREIGN PATENTS OR APPLICATIONS

| | | | |
|---|---|---|---|
| 2,202,253 | 8/1973 | Germany | 72/129 |
| 2,019,498 | 11/1971 | Germany | 72/294 |

*Primary Examiner*—Michael J. Keenan
*Attorney, Agent, or Firm*—Ernest F. Marmorek

[57] ABSTRACT

The invention concerns a bending machine for bar or rod material such as reinforcement bars for reinforcing concrete. The machine includes a bending mandrel which is stationary during the bending process and a bending tool which can be pivoted about the mandrel. Directly in front of the bending mandrel in the direction of the feed path of the bar or rod material are positioned two clamping cheeks movable relative to one another in a direction perpendicular to the feed path of the material, the cheeks each including a clamping face substantially parallel with the feed path and a cutting face substantially perpendicular to the respective clamping face, the lines of intersection of these faces forming cutting edges substantially parallel with one another. The clamping cheeks are also movable relative to one another in a direction substantially parallel toward the feed path so that they can be displaced from a clamping position in which their respective cutting edges are offset from one another and their clamping faces face one another, into a cutting position in which their cutting edges are aligned and the clamping faces are offset from one another.

6 Claims, 2 Drawing Figures

MACHINE FOR BENDING BAR OR ROD MATERIAL

Figure 1:
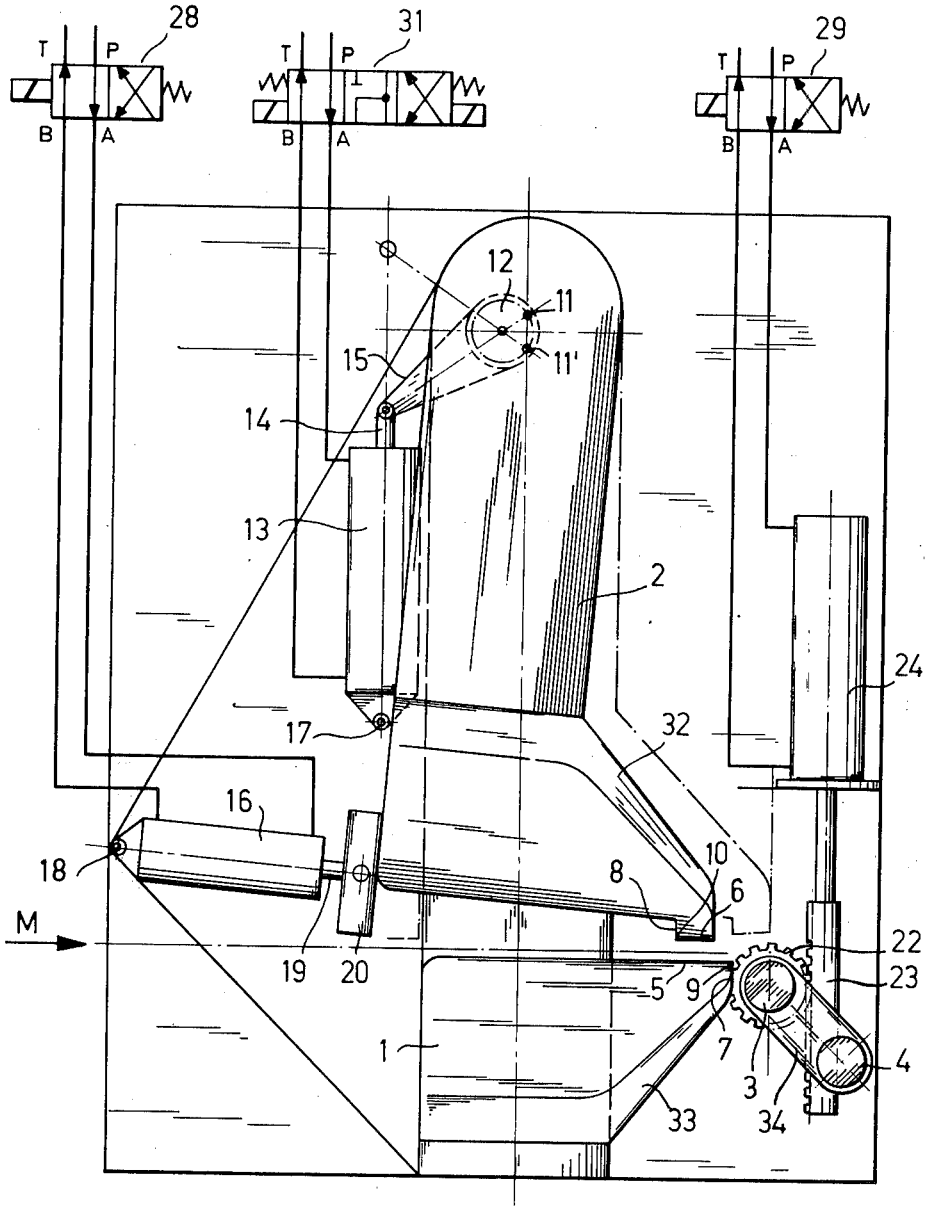

For the bending of bar or rod material, in particular of reinforcement bars for reinforced concrete construction, it is known to use bending-machines which include at least one bending-mandrel which is stationary during the bending process, and one bending-tool, e.g., in the form of a bending-roller which can be pivoted about this mandrel. Bending-machines of this kind are use to produce thrust stirrups, for example, which in reinforced concrete construction are necessary in large quantities.

The production process usually proceeds completely automatically, controlled by a programmed controller.

The bending machine is equipped with a motor-driven feeder which withdraws the bar material from a storage reel and a presettable measuring device measures the length of the bar material as it is fed forwards and stops the feeder as soon as the required length of material has been pulled off the reel. A straightener inserted in the feed path of the material, and which consists of a number of groups of straightener rolls arranged in different planes, straightens the bar material as it is fed forward. As soon as a feed step is concluded the actual bending mechanism is automatically set in motion to bend the bar through a likewise presettable angle, whereupon either a further bending process is initiated by the programmed controller or a cutting mechanism arranged near the stationary bending-mandrel is actuated to cut the bent rod to length.

After the cut has been performed another cycle of feeding and bending steps is initiated by the programmed controller, which again ends in a cut. A machine of this kind is described in the Austrian Patent Specification No. 314,319.

With bending-machines of that kind, however, it is not readily possible to bend bars having circumferential ribs or circumferential rows of ribs in such a way that the bar during bending does not get twisted so that for example, in the case of an end product in the form of a closed rectangular bar chain as may perhaps be employed as a thrust stirrup for reinforced concrete beams, all four sides of the bar chain always lie with certainty in one and the same plane.

In accordance with our earlier proposal (cf. Austrian Patent Application A 10037/74) undesirable twisting of the bar during bending is prevented by a clamping mechanism being provided along the material feed path directly before the bending-mandrel which is stationary during the bending process, the clamping mechanism being actuable in dependence upon the actuation of the pivotable bending-tool and is capable during the time of actuation of the pivotable bending-tool, of clamping the barlike material firmly against twisting.

In this earlier proposal it was also further suggested that the stationary clamping-cheek of the clamping mechanism should at the same time be formed as the stationary blade of a shear used for cutting the barlike material to length.

The present invention is concerned with the problem of equipping a bending-mechanism of the kind specified above, with a combined clamping and cutting mechanism and in accordance with the present invention the clamping-cheeks are movable relative to one another in a direction perpendicular to the feed path of the material, the cheeks each including a clamping-face substantially parallel with the feed path and a cutting-face substantially perpendicular to the respective clamping-face the lines of intersection of these faces forming cutting-edges substantially parallel with one another, the clamping-cheeks also being movable relative to one another in a direction substantially parallel with the feed path so that they can be displaced, from a clamping position in which their respective cutting-edges are offset from one another and their clamping-faces face one another, into a cutting position in which their cutting edges are aligned and the clamping-faces are offset from one another.

Preferably, the relative mobility of the two clamping-cheeks with respect to one another both in the direction perpendicular to the feed path of the bar or rod material and also in a direction substantially parallel with this feed path is achieved by the fact that there are provided a lowering shaft arranged at a distance from the feed path of the bar or rod material and in a direction at right angles to the feed path and, arranged on this shaft, an eccentric on which one of the two clamping-cheeks is pivotally supported, and devices are provided for pivoting the lowering-shaft about its axis as well for pivoting the clamping-cheeks about the eccentric.

In order to avoid waste of bar material and to be able to work as economically as possible it is desirable to sever the bar or rod material after the last bending process as close to the last point of bend as is possible or respectively is possible according to the required specification for the thrust stirrups. It is therefore advantageous to arranged the stationary clamping-cheek which is at the same time used as the stationary blade, as close as possible to the bending-mandrel during the bending process and to form at least the bending-mandrel in such a way that it may be withdrawn from the plane of bend so that it does not obstruct the clamping-cheek which is used as the moving blade during the cutting process. If necessary also the pivotable bending-tool is able to shift in the direction perpendicular to the plane of bend and devices are provided which are capable of retracting the bending-mandrel and if necessary the pivotable bending-tool, out of the plane of bend when the clamping-cheeks are brought into the cutting position.

Although naturally every kind of drive which serves the purpose may be applied to the clamping, bending and cutting tools of a bending-machine in accordance with the invention, a hydraulic drive proves particularly advantageous, wherefore in the case of a bending-machine in accordance with the invention hydraulic operating cylinders are preferably provided for pivoting the lowering shaft about its axis, for pivoting the clamping-cheek about the eccentric and for moving the bending-mandrel and if necessary the pivotable bending-tool in the direction perpendicular to the plane of bend.

In order on the one hand not to deform the length of material during the bending process by too great clamping forces and on the other hand to be able to bring into effect upon the clamping-cheek which is used as the movable blade sufficiently large forces for the cut, in accordance with a further feature of the invention the piston in the hydraulic operating cylinder which pivots the lowering-shaft can at option be acted upon by pressure on the face opposite the piston rod, on the face adjacent the piston rod or on both faces at once.

Figure 2:
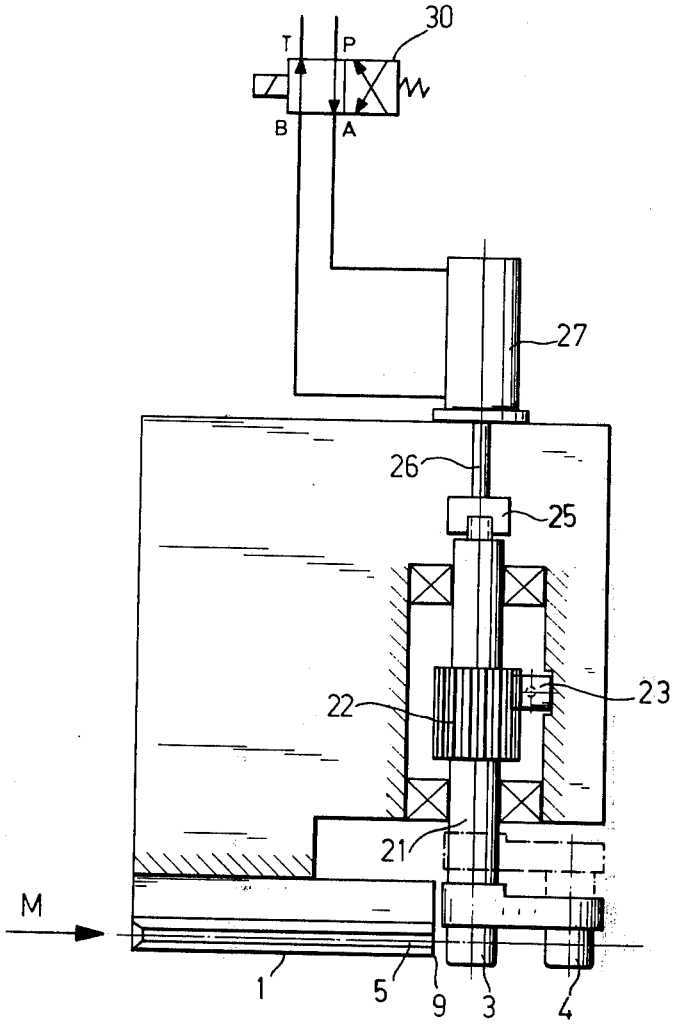

One example of a machine according to the invention will now be described in greater detail with reference to the accompanying drawings, in which:

FIG. 1 shows the combined clamping and cutting tools as well as the bending-tool of the bending machine in elevation; and, FIG. 2 shows in plan, a section through FIG. 1 at the height of the feed path of the barlike material.

The axis of the bar or rod material which is to be bent and the direction of motion of the material are indicated in the drawing by an arrow M which at the same time also gives the position and direction of the feed path of this material inside the bending-machine.

Underneath the feed path M there is arranged a stationary clamping-cheek 1 and above it a movable clamping-cheek 2.

Behind the two clamping-cheeks 1, 2 in the direction of feed of the strand of material lies a bending-mandrel 3 which is stationary during the bending process and about which a bending-tool 4 which in the embodiment illustrated has the shape of a roller, can be pivoted by means of a swinging arm 34. Each of the two clamping-cheeks 1, 2 exhibits a clamping-face 5, 6 respectively running parallel with the feed path M of the strand of material. The clamping-faces 5, 6 form together with cutting-faces 7 and 8 respectively running essentially perpendicular to them, cutting-edges 9, 10 parallel with one another.

The movable clamping-cheek 2 is supported so as to be able to pivot about an eccentric indicated only by its axis 11, which is arranged on a shaft 12. The shaft 12 is supported rotatably in the machine frame and is used for lowering the movable clamping-cheek during bending and during cutting.

A hydraulic operating-cylinder 13 hinged to the machine frame at 17 and the piston rod 14 of which is hinged to a single-arm lever 15, which is connected fixedly in rotation to the lowering-shaft 12, allows the shaft 12 to be rotated about its axis. By such pivotal motion the axis 11 of the eccentric arrives at 11', i.e., its clearance from the axis of the bar or rod material M is reduced and the clamping-cheek 2 therefore executes a lowering motion in the direction towards the feed path of the bar material.

A second hydraulic operating-cylinder 16 is hinged at 18 to the machine frame. Its piston rod 19 is hinged to a plate 20 which at the same time is used as a stop limiting the position of the clamping-cheek 2 when it is swung into the cutting position, so that by acting upon the operating piston in the cylinder 16 the clamping-cheek 2 can be swung about the axis 11 of the eccentric. The clamping-cheek 2 can thereby be swung from its clamping position which is shown in solid line in FIG. 1, into its cutting position shown in dash-dot line in FIG. 1, and back again.

Since the clamping-cheeks 1, 2 for the reasons already stated are arranged close up against the stationary bending-mandrel 3, in the embodiment illustrated the bending-tools 3, 4 are formed to be retractable as a whole out of the plane of bend in the direction perpendicular to this plane in order not to impede the cutting process in direct proximity to the last point of bend.

The stationary bending-mandrel 3 is for this reason mounted on a shaft 21 onto which is keyed a pinion 22. This engages with a rack 23 which can be displaced by the piston rod of a hydraulic operating-cylinder 24, whereby the bending-tool 4 executes a swinging motion about the stationary bending-mandrel 3.

The shaft 21 is by means of a coupling 25 connected rotatably but not displaceably to the piston rod 26 of an operating-cylinder 27 which can slide the bending-tools 3, 4 forwards into and retract them from the plane of bend.

The admission of pressure medium to the hydraulic cylinders 16, 24 and 27 is controlled by electrohydraulic spool-valves 28, 29, 30 of known construction. Each of these spool-valves exhibits two possible switch positions with each of which is associated the motion of the operating piston in the cylinder in a certain direction.

The electrohydraulic spool-valve 31, however, which controls the admission of pressure medium to the operating-piston in the cylinder 13, shows a different construction. This slidevalve can be brought into three different switch positions. In the extreme righthand position of the spool, as shown in FIG. 1, the piston in the operating-cylinder is acted upon in the direction of a downwards motion. The piston in the operating-cylinder 13 is thereby acted upon by pressure medium on the face adjacent the piston rod, the axis 11 of the eccentric is brought into the position shown in FIG. 1 and held in it, and the clamping-cheek 2 is separated from the clamping-cheek 1 and releases the barlike material clamped between the clamping-cheeks 1, 2.

If the spool 31 is shifted out of the position shown right over to the left, the piston in the operating cylinder will be acted upon by pressure medium in the direction of a upwards motion, that is, on the face opposite the piston rod. In that case the axis of the eccentric gets shifted in the direction towards 11' in FIG. 1 and the clamping-cheek 2 is pressed downwards with maximum force.

In the mid-position of the spool 31 the operating piston in the cylinder 13 gets acted upon by pressure medium on both sides at once. In this position a resultant upwards force is arranged to act on the piston, which causes a shift of the axis of the eccentric in the direction from 11 towards 11', this force being equal to the product of the liquid pressure and the area of cross-section of the piston rod 14. This force is therefore significantly smaller than the forces which in the two end positions of the spool 31 are exerted on the piston in the cylinder 13.

By an electronic controller of the usual kind, which is not part of the invention and therefore does not need to be explained in further detail, the spool 31 is controlled in such a way that as long as the clamping-cheek 2 is in the clamping position shown in FIG. 1 the spool 31 can only be brought into the position shown or into the mid-position. If the spool 31 is in its mid-position the clamping-cheek 2 is pressed against the strand of material with adequate force to clamp it firmly against twisting without however there being any danger of deformation of the material because of too high a pressure.

Only if the clamping-cheek 2 is brought into the cutting position can the electrohydraulic spool be switched into its extreme lefthand position in order to bring into effect the full force corresponding with the product of the liquid pressure and the cross-section of the piston for severing the strand of material.

Finally it may further be mentioned that the clamping-cheeks 1 and 2 advantageously exhibit oblique wedge surfaces 32, 33 which face towards the bending-tools 3 and 4. These wedge surfaces serve to guide past the clamping-cheek barlike material being moved during the bending process in the direction of the clamping-cheeks, in order to prevent catching of the material on the clamping-cheeks.

We claim:

1. A machine for bending bar or rod material, said machine comprising at least one stationary bending mandrel and one bending tool, said bending tool being pivotable about said mandrel; a pair of clamping cheeks, said cheeks being positioned directly in front of said bending mandrel in the direction of the feed path of said bar or rod material and said cheeks each including a clamping face, said clamping face arranged substantially parallel with said feed bar, and a cutting face, said cutting face being arranged substantially perpendicular to said respective clamping face, said cutting faces and said clamping faces intersecting to form cutting edges substantially parallel with one another, said clamping cheeks also being movable relative to one another in a direction substantially parallel with said feed path whereby said clamping cheeks may be relatively displaced from a clamping position in which their respective cutting edges are offset and their clamping faces face one another, into a cutting position in which said cutting edges are aligned and said clamping faces are offset.

2. A machine according to claim 1, said machine including a lowering shaft, said shaft being supported at a distance from and in a direction transverse to said feed path, one of said clamping cheeks being pivotally supported on an eccentric, said eccentric being mounted on said lowering shaft, and including devices adapted to pivot said lowering shaft about its axis and to pivot said respective clamping cheek about said eccentric.

3. A machine according to claim 1, wherein said bending mandrel is arranged to move in a direction perpendicular to the plane of bending, and including means for retracting said bending mandrel out of said plane of bending when said clamping cheeks are brought into said cutting position.

4. A machine according to claim 3 wherein said bending tool is arranged to move with said bending mandrel perpendicularly to said plane of bending.

5. A machine according to claim 3 wherein said machine includes hydraulic operating cylinders for pivoting said lowering shaft about its axis, for pivoting said clamping cheek about said eccentric and for moving said bending mandrel out of said plane of bending.

6. A machine according to claim 5, wherein said hydraulic operating cylinder for pivoting said lowering shaft includes a piston which is arranged to be acted upon by pressure on the face opposite said piston rod or on the face adjacent said piston rod or on both faces together.

* * * * *